US010961788B2

(12) United States Patent
Russo et al.

(10) Patent No.: US 10,961,788 B2
(45) Date of Patent: Mar. 30, 2021

(54) COMPRESSION SET DOWNHOLE CLUTCH

(71) Applicant: HALLIBURTON ENERGY SERVICES, INC., Houston, TX (US)

(72) Inventors: Christopher Dale Russo, Lafayette, LA (US); Jacob Boutin, Lafayette, LA (US); David J. Tilley, Franklin, LA (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 733 days.

(21) Appl. No.: 14/415,528

(22) PCT Filed: Mar. 5, 2014

(86) PCT No.: PCT/US2014/020851
§ 371 (c)(1),
(2) Date: Jan. 16, 2015

(87) PCT Pub. No.: WO2015/134015
PCT Pub. Date: Sep. 11, 2015

(65) Prior Publication Data

US 2015/0361730 A1 Dec. 17, 2015

(51) Int. Cl.
*E21B 17/06* (2006.01)
*E21B 17/05* (2006.01)
(Continued)

(52) U.S. Cl.
CPC ..... *E21B 17/06* (2013.01); *E21B 17/046* (2013.01); *E21B 17/05* (2013.01); *E21B 17/07* (2013.01)

(58) Field of Classification Search
None
See application file for complete search history.

(56) References Cited

U.S. PATENT DOCUMENTS 3,182,777 A 5/1965 Browning et al.
4,313,495 A 2/1982 Brabdell
(Continued)

FOREIGN PATENT DOCUMENTS

AU 2014385252 B2 9/2017
CA 2256069 6/2000
(Continued)

OTHER PUBLICATIONS

Dictionary definition of "spline", accessed Nov. 14, 2017 via www.thefreedictionary.com.*
(Continued)

*Primary Examiner* — Blake E Michener
(74) *Attorney, Agent, or Firm* — Polsinelli PC

(57) ABSTRACT

Compression set downhole clutch (100) can include an upper body (201), a lower body (202), and a hydraulic member (205). The upper body (201) can include at least one engagement surface (204). The lower body (202) can include at least one engagement surface (203). The at least one engagement surface (204) of the upper body (201) and the at least one engagement surface (203) of the lower body (202) can each be configured to couple with one another and rotate in unison in an engaged configuration (102). The hydraulic member (205) can be configured to be responsive to a predetermined pressure; the hydraulic member (205) can also be configured to disengage the engagement surface (204) of the upper body (201) from the engagement surface (203) of the lower body (202).

18 Claims, 9 Drawing Sheets

(51) Int. Cl.
*E21B 17/07* (2006.01)
*E21B 17/046* (2006.01)

(56) References Cited

U.S. PATENT DOCUMENTS

| | | | | |
|---|---|---|---|---|
| 5,404,944 | A | 4/1995 | Lynde et al. | |
| 5,458,208 | A | 10/1995 | Clarke | |
| 5,836,396 | A | 11/1998 | Norman | |
| 6,082,457 | A | 7/2000 | Best et al. | |
| 6,289,986 | B1 | 9/2001 | Wright et al. | |
| 6,307,290 | B1 * | 10/2001 | Scarsdale | E21B 43/128 310/87 |
| 6,997,271 | B2 | 2/2006 | Nichols et al. | |
| 7,011,162 | B2 * | 3/2006 | Maguire | E21B 17/05 166/242.6 |
| 7,311,157 | B1 | 12/2007 | Clarke | |
| 7,735,581 | B2 | 6/2010 | Beylotte et al. | |
| 8,069,925 | B2 | 12/2011 | Obrejanu | |
| 8,307,919 | B2 | 11/2012 | Hall et al. | |
| 8,322,461 | B2 | 12/2012 | Hay et al. | |
| 9,163,736 | B2 * | 10/2015 | Kyllingstad | E21B 21/106 |
| 2005/0126775 | A1 | 6/2005 | Van et al. | |
| 2011/0214963 | A1 | 9/2011 | Beylotte et al. | |
| 2011/0240313 | A1 | 10/2011 | Knobloch et al. | |
| 2012/0285703 | A1 | 11/2012 | Abraham et al. | |

FOREIGN PATENT DOCUMENTS

| | | | |
|---|---|---|---|
| WO | 88-01678 | | 3/1988 |
| WO | 9719248 | | 5/1997 |
| WO | WO 9719248 | * | 5/1997 |

OTHER PUBLICATIONS

WODownhole Clutch; Product 20-129; http://techwesttools.com/assets/pdfs/twinc/tubinganchors/downhole_clutch.pdf.; published 2008 and retrieved Nov. 14, 2013.

Downhole Clutch Swivel; http://www.mostoil.com/wp-content/uploads/productions/Down-Hole-Clutch-Swivel.pdf; retrieved on Nov. 14, 2013.

Novel Jar Technology—The Down Hole Clutch; https://www.onepetro.org/conference-paper/SPE-59234-MS; published 2000 and retrieved on Nov. 14, 2013.

The International Search Report and Written Opinion dated Dec. 5, 2014; In PCT patent application No. PCT/US2014/020851.

Office Action; Malaysia Application No. PI 2016001158; dated Sep. 24, 2019.

* cited by examiner

COMPRESSION SET DOWNHOLE CLUTCH

CROSS-REFERENCE TO RELATED APPLICATIONS

This application is a national stage entry of PCT/US2014/020851 filed Mar. 5, 2014, said application is expressly incorporated herein in its entirety.

FIELD

The subject matter herein generally relates to a downhole tool, in particular the downhole tool is controlling torque loads between two different segments of a drillstring.

BACKGROUND

In completing a well, a well operator can install casing in a well bore. The casing sometimes has different inside diameters along a length of the well. The change in inside diameter can require that the operator use a sufficiently small diameter drillstring to fit inside the smallest inside diameter of the casing, or to use a number of different diameter pipes of different lengths to reach the bottom of the well.

BRIEF DESCRIPTION OF THE DRAWINGS

Implementations of the present technology will now be described, by way of example only, with reference to the attached figures, wherein.

DETAILED DESCRIPTION

Figure 1:
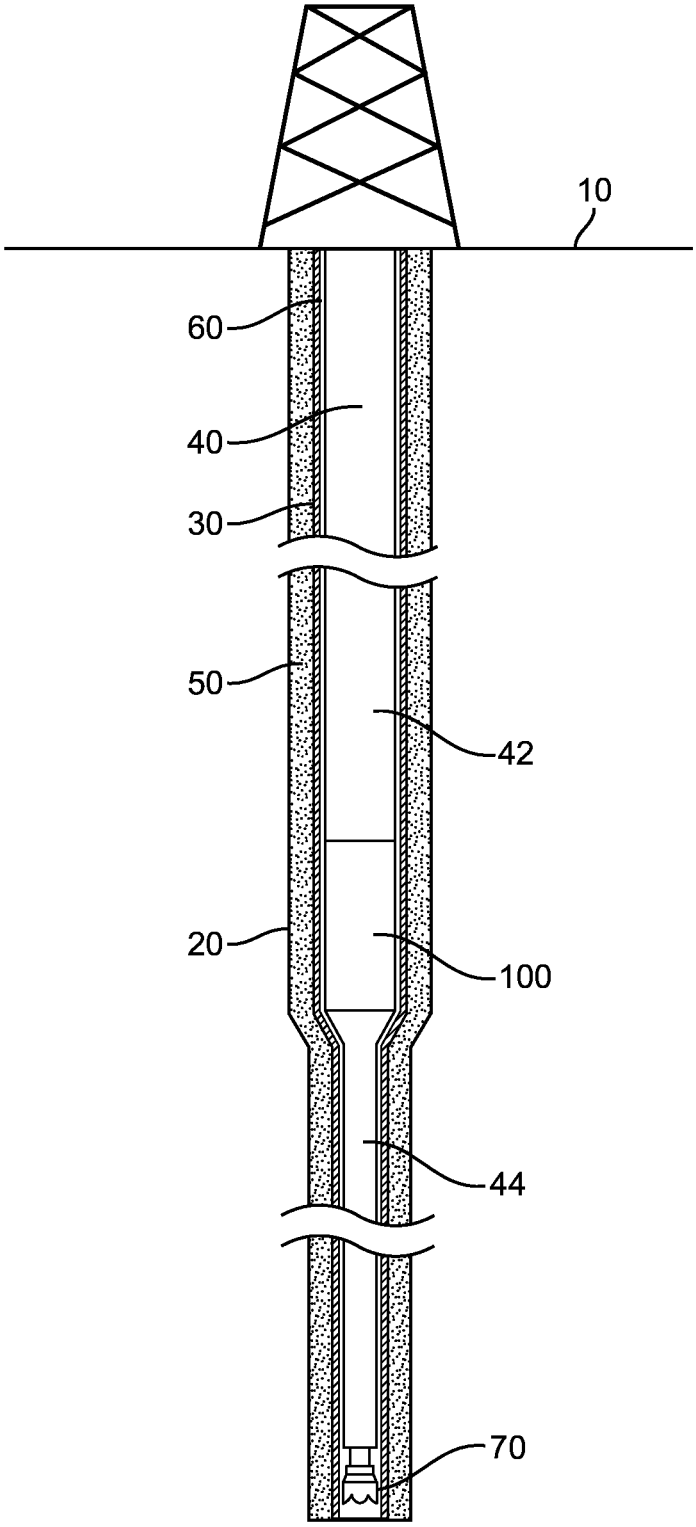
FIG. 1 is an example of a subterranean well and a compression set downhole clutch in accordance with an exemplary embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the following description, terms such as "upper," "upward," "lower," "downward," "above," "below," "downhole," "uphole," "longitudinal," "lateral," and the like, as used herein, shall mean in relation to the bottom or furthest extent of, the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrated embodiments are illustrated such that the orientation is such that the right-hand side is downhole compared to the left-hand side.

Several definitions that apply throughout this disclosure will now be presented. The term "coupled" is defined as connected, whether directly or indirectly through intervening components, and is not necessarily limited to physical connections. The connection can be such that the objects are permanently connected or releasably connected. The term "inside" indicate that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "fluid communication" is defined as allowing fluid to flow between the components either directly or indirectly through additional components. The term "around" is defined as being substantially on every side of at least a portion of an object.

The present disclosure is described in relation to an exemplary compression set downhole clutch (hereinafter a "clutch"), which can selectively disengage a portion of the drillstring downhole of the clutch. The clutch can be configured to disengage when a compressive load is present at the clutch. The compression of the clutch can occur when the drillstring contacts either the bottom of the hole or when a portion of the clutch contacts a neck down region of a casing or a wellbore. Prior to the clutch's being under compression, the clutch can be in tension due to the weight of the drillstring downhole of the clutch. When in tension, the clutch can transmit torque to the drillstring downhole of the clutch. In this configuration, the drillstring above and below the clutch can rotate at substantially the same speed.

The presently disclosed clutch can also be configured so that it can be cycled from an engaged configuration to a disengaged configuration and from the disengaged configuration to the engaged configuration. The clutch can be configured so that when the clutch experiences a compression that is greater than a predetermined pressure, the clutch disengages. The clutch can be further configured so that the clutch re-engages once the compression pressure is less than the predetermined pressure. In other embodiments, the clutch can remain disengaged until the predetermined pressure is substantially released. For example, the clutch can remain disengaged until less than twenty-five percent of the predetermined pressure is present.

The predetermined pressure can be determined and set in dependence upon the intended operation parameters of the clutch. For example, in a well that has been cased, it can be necessary to clean the well prior to production. The casing of the well can neck down from a first inside diameter to a second inside diameter that is smaller than the first inside diameter. If a drillstring is inserted into the casing, the drillstring must likewise change diameters. If a portion of the drillstring impacts the neck region, the impact can cause the lower portion of the drillstring to be sheared off from the upper portion of the drillstring. With the present clutch coupling an upper portion of the drillstring with the lower portion of the drill string, the clutch can be configured to disengage the lower portion of the drillstring when a compressive pressure is exceed. The present clutch can be implemented in other environments in which is desirable to disengage a portion of the drillstring from a rotating portion of the drill string in response to a predetermined pressure's being exceeded. While a predetermined pressure is described herein, the present disclosure can also be described in terms of a predetermined force, since the area of interest can be known.

A clutch can comprise an upper body comprising at least one engagement surface. The clutch can also comprise a lower body comprising at least one engagement surface. Still further, the clutch can comprise the engagement surface of the upper body and engagement surface of the lower body wherein each are configured to couple and rotate in unison until a predetermined compression load is reached. The clutch can further comprise a hydraulic member configured to be responsive to a predetermined pressure, the hydraulic member being configured to disengage the engagement surface of the upper body from the engagement surface of the lower body.

The hydraulic member can comprise a relief valve member. The hydraulic member can also comprise a first relief valve and a second relief valve, the first relief valve having a first pressure setting corresponding to the predetermined pressure and the second relief valve having a second pressure setting that is less than the first pressure setting. In at least one embodiment, the first relief valve and the second relief valve can be formed as one valve such that flow in a first direction corresponds to the first pressure setting and flow in a second direction corresponds to the second pressure setting. The remainder of the disclosure generally refers to a first relief valve and a second relief valve, but these can be combined into a single valve. In at least one embodiment, the second relief valve can be described as a check valve that has a low cracking pressure. For example, the cracking pressure can be less than 7000 pascals or about one pound per square inch. In other examples, the low cracking pressure can be 2000 pascals or about one third of a pound per square inch. The hydraulic member can further comprise a first hydraulic chamber and a second hydraulic chamber which are in fluid communication. The first relief valve and the second relief valve couple the first hydraulic chamber to the second hydraulic chamber.

The lower body can disengage from the upper body in response to the first relief valve allowing fluid to flow into the second hydraulic chamber from the first hydraulic chamber. The second relief valve can be configured to allow fluid to flow from the second hydraulic chamber into the first hydraulic chamber if the pressure is less than the first predetermined pressure. The first hydraulic chamber can be located uphole relative to the first relief valve and relative to the second relief valve. The second hydraulic chamber can have a movable seal located downhole relative to the first relief valve and relative to the second relief valve. The moveable seal can be configured to prevent a pressure differential from building within the second hydraulic chamber by allowing the seal to move and thereby adjust to the surrounding pressure outside of the second hydraulic pressure chamber. The second relief valve can be configured to communicate the pressure change experienced by the second hydraulic chamber to the first hydraulic chamber.

The hydraulic member can further comprise a thrust bearing configured to take up thrust when the lower body is disengaged from the upper body. The hydraulic member can further comprise a plunger piston configured to expand in response to the compression load. The thrust bearing can couple with the plunger piston. The clutch can be configured to stroke inwardly in response to the compression load becoming equal to the predetermined compression load, wherein the upper body and lower body engagement surfaces disengage in response to the clutch stroking inwardly.

Referring to FIG. 1, an example of a well according to the present technology is illustrated. As illustrated, the borehole 20 extends into the earth from the surface 10. A casing 30 can be installed within the borehole 20 and extends into the earth from the surface 10. A drillstring 40 extends through the casing 30 and includes a clutch 100. Between borehole 20 and casing 30 form an outer annulus 50 that can be filled with cement when the casing 30 is completely installed within the borehole. Between casing 30 and the drillstring 40 is an inner annulus 60. The clutch 100 can be located where a drillstring necks down such that it joins an upper drillstring 42 having a first outer diameter to a lower drillstring 44 having a second outer diameter, the second outer diameter being smaller than the first outer diameter. The drillstring 40 can further include a cleaning tool 70 located at a distal downhole end of the drillstring 40. In at least one embodiment, the cleaning tool 70 can be a drill bit.

Figure 2:
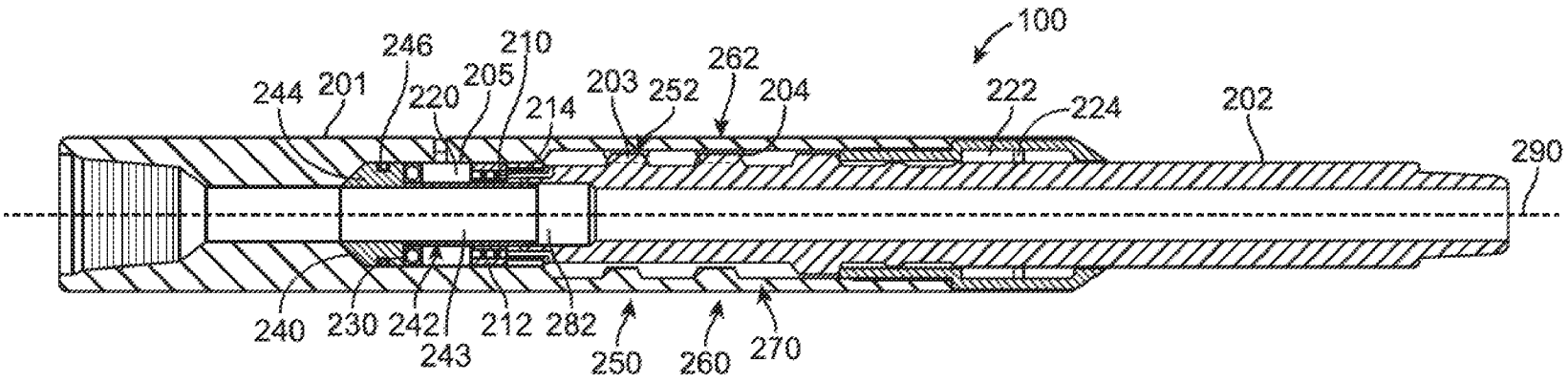
FIG. 2 is a cross-sectional view of a compression set downhole clutch when in tension in accordance with an exemplary embodiment.

Referring to FIG. 2, a partial view of a clutch 100 in tension, in accordance with an exemplary embodiment, is presented. The clutch 100 can include an upper body 201 and a lower body 202. The upper body 201 can be configured to at least partially cover the lower body. The upper body 201 can include at least one engagement surface 204. In at least one embodiment, the at least one engagement surface 204 can be formed on an interior 270 of the upper body 201. In one embodiment, the upper body 201 can be machined so that the at least one engagement surface 204 is formed on the interior 270. In other embodiments, the at least one engagement surface 204 can be coupled to an interior 270 of the upper body 201.

The at least one engagement surface 204 of the upper body 201 can be configured to couple with at least one engagement surface 203 of the lower body 202. The at least one engagement surface 204 of the upper body 201 can be configured to matingly couple with a corresponding one of the at least one engagement surface 203 of the lower body 202. When the clutch 100 is in tension, the at least one engagement surface 204 of the upper body 201 can be engaged with the at least one engagement surface 203 of the lower body 202. The engagement surfaces (203, 204) can be configured to transfer torque from the upper body 201 to the lower body in the tension configuration or the engaged configuration.

The engagement surfaces (203, 204) can be configured to provide for effective transfer of torque between the upper body 201 and the lower body 202. For example, the at least one engagement surface 204 of the upper body 201 can be at least one spline. In at least one embodiment, the at least one spline can be a trapezoidal prism in shape. The present disclosure contemplates that the at least one engagement surface 204 of the upper body 201 can have different shapes configured to provide for effective transfer or torque, for example, raised ridges, straight splines, triangular prism shapes and other suitable shapes.

Similarly, at least one engagement surface 204 of the lower body 202 can be at least one spline. In at least one embodiment, the at least one spline can be a trapezoidal prism in shape. The present disclosure contemplates that the at least one engagement surface 203 of the lower body 202 can have different shapes configured to provide for effective transfer of torque, for example, raised ridges, straight splines, triangular prism shapes and other suitable shapes.

In at least one embodiment, the at least one engagement surface 204 of the upper body 201 can comprise a first row 250 and a second row 260 of engagement surfaces 204. In at least one embodiment, the first row 250 and the second row 260 can comprise splines. In other embodiments, the first row 250 and the second row 260 can comprise any of the above described shapes. Additionally, in at least one embodiment, the shape of the at least one engagement surface 204 in the first row 250 can be different from the shape of the at least one engagement surface 204 in the second row 260. In other embodiments, such as the one illustrated, the at least one engagement surface 204 in the first row 250 can be substantially of the same shape of the at least one engagement surface 204 in the second row 260. In at least one embodiment, the first row 250 can comprise four members and the second row 260 can comprise four members. The number of members of each row (250, 260) can be selected based on the diameter of the upper body 201.

In at least one embodiment, the at least one engagement surface 203 of the lower body 202 can comprise a first row 252 and a second row 262 of engagement surfaces 203. In at least one embodiment, the first row 252 and the second row 262 can comprise splines. In other embodiments, the first row 252 and the second row 262 can comprise any of the above described shapes. Additionally, in at least one embodiment, the shape of the at least one engagement surface 203 in the first row 252 can be different from the shape of the at least one engagement surface 203 in the second row 260. In other embodiments, such as the one illustrated, the at least one engagement surface 203 in the first row 252 can be substantially of the same shape of the at least one engagement surface 203 in the second row 262. In at least one embodiment, the first row 252 can comprise four members and the second row 262 can comprise four members. The number of members of each row (252, 262) can be based on the diameter of the upper body 201 or lower body 202. While the remaining description is generally presented with respect to at least one engagement surface 204 of the upper body 201 and at least one engagement surface 203 of the lower body 202, it can be appreciated that details described above can be implemented in the embodiments presented herein.

The clutch 100 can also comprise a hydraulic member 205. The hydraulic member 205 can be configured to be responsive to a predetermined pressure. The hydraulic member 205 can also be configured to disengage the at least one engagement surface 204 of the upper body 201 from the at least one engagement surface 203 of the lower body 202. The hydraulic member 205 can be configured to disengage and reengage the engagement surfaces (203, 204) of the upper body 201 and lower body 202 based on the compressive force experienced by the clutch 100.

The hydraulic member 205 can comprise a relief valve member 210, which can be activated at the predetermined pressure. The predetermined pressure as described herein is a pressure that the clutch is configured to disengage. As mentioned above, this predetermined pressure can be in response to the clutch 100 being compressed as it is placed on a collar of a necked region of a wellbore or casing. The clutch 100 can be configured to be responsive to other types of compressive pressure as well.

In at least one embodiment, the hydraulic member 205 can comprise a first relief valve 212 and a second relief valve 214. The first relief valve 212 can have a first pressure setting corresponding to the predetermined pressure. The second relief valve 214 can have a second pressure setting that is less than the first pressure setting. In at least one embodiment, the first relief valve can comprise a ball and a biasing member, for example a spring. The pressure that the biasing member supplies to the ball can be chosen based on the desired disengagement pressure. In at least one embodiment, the pressure can be 2000 pounds per square inch (psi) or about 13.8 megapascal (MPa) gauge pressure. The pressure is described in terms of gauge pressure, as the clutch 100 is configured to operate in downhole environments which are subject to pressures in excess of 10,000 psi or about 69 MPa. In at least one embodiment, the second pressure setting can correspond to substantially zero gauge pressure. In this configuration, the second relief valve 214 allows for the hydraulic member 205 to return to the engaged configuration. In at least one embodiment, the second relief valve can be described as a check valve that has a low cracking pressure. For example, the cracking pressure can be less than 7000 pascals or about one pound per square inch. In other examples, the low cracking pressure can be 2000 pascals or about one third of a pound per square inch.

The configuration of the first relief valve 212 and the second relief valve 214 can be configured so that the clutch can remain disengaged until substantially all of the pressure on the clutch is released. For example, the clutch can remain disengaged until less than twenty-five percent of the predetermined pressure is present. In yet other embodiments, the clutch remains disengaged until less than ten percent of the predetermined pressure is present on the clutch. In yet other embodiments, the clutch remains disengaged until the clutch returns to a state in which no predetermined pressure is present on the clutch. In other embodiments, the clutch can be configured to be re-engaged when the pressure on the clutch is less than the predetermined pressure.

The hydraulic member 205 can also comprise a first hydraulic chamber 220 and a second hydraulic chamber 222. The second hydraulic chamber 222 can be in fluid communication with the first hydraulic chamber 220 so that fluid can be exchanged between the first hydraulic chamber 220 and the second hydraulic chamber 222, when the predetermined pressure is exceeded. Once pressure is less than the predetermined pressure, the fluid can be exchanged between the second hydraulic chamber 222 and the first hydraulic chamber 220, until the clutch 100 returns to the tension or engaged configuration. Thus, the hydraulic member 205 can be further configured to reengage the at least one engagement surface 204 of the upper body 201 with the at least one engagement surface 203 of the lower body 202, when a pressure on the clutch 100 is less than the predetermined pressure.

In at least one embodiment, a first relief valve 212 and a second relieve valve 214 can couple the first hydraulic chamber 220 to the second hydraulic chamber 222. The lower body 202 can be disengaged from the upper body 201 in response to the first relief valve 212 opening at the predetermined pressure and allowing fluid to flow into the second hydraulic chamber 222 from the first hydraulic chamber 220. When the compressive pressure is removed, the second relief valve 214 can be set to allow fluid to flow from the second hydraulic chamber 222 into the first hydraulic chamber 220 in the event that the pressure is less than the first predetermined pressure. As illustrated the first hydraulic chamber 220 can be located uphole relative to the first relief valve 212 and the second relief valve 214.

In at least one embodiment, the first hydraulic chamber 220 and the second hydraulic chamber 222 can be configured to change dimensions. For example, the first hydraulic chamber 220 can have a larger volume in a tension or engaged configuration as compared to the volume of the first hydraulic chamber 220 in the compressed or disengaged configuration. Similarly, the second hydraulic chamber 222 can have larger volume in a compressed or disengaged configuration as compared to the volume of the second hydraulic chamber 222 in the tension or engaged configuration. As the clutch 100 transitions from the each configuration, the volumes of the respective first hydraulic chamber 220 and the second hydraulic chamber 222 can change in unison.

In order to provide for the volume change in the second hydraulic chamber 222, the second hydraulic chamber 222 can include a movable seal 224 that can be located downhole relative to the first relief valve 212 and the second relief valve 214. The movable seal 224 can provide a bottom of the second hydraulic chamber 222. The movable seal 224 can be configured for sliding engagement of inside of the upper body 201. In at least one embodiment, the moveable seal 224 can be a T-seal. The moveable seal 224 as described substantially maintains pressure equilibrium between the second hydraulic chamber 222 and the outside of the second hydraulic chamber 222. For example, higher external pressure acting on the moveable seal 224 can cause the seal to slide upward, thereby reducing the size of the second hydraulic chamber 222. By having the moveable seal 224 act in this manner, the second hydraulic chamber 222 is enabled to continue to operate at various depths in the downhole environment, depths which cause substantial changes in downhole pressure acting on the moveable seal 222. The moveable seal 224 can prevent premature motion or stroking of the tool due which could otherwise be caused by an imbalance between the internal pressure in the first hydraulic chamber 220 and the external pressure, or an imbalance between the internal pressure in the second hydraulic chamber 222 and the external pressure. Additionally, the second relief valve 214 can be configured to communicate changes in external pressure to the first hydraulic chamber 220. Additionally, the moveable seal 224 allows for movement of fluid from the first hydraulic chamber 220 to the second hydraulic chamber in response to the predetermined pressure. Likewise, the moveable seal 224 further allows the second hydraulic chamber 222 to decrease in volume as fluid flows from the second hydraulic chamber 222 into the first hydraulic chamber 220.

The first hydraulic chamber 220 can be at least partially formed by a plunger piston 240. In at least one embodiment, the plunger piston 240 can be configured to collapse in response to the compression load. The collapse of the plunger piston 240 causes the at least one engagement surface 204 of the upper body 201 and the at least one engagement surface 203 of the lower body 202 to disengage from one another. The piston plunger 240 can include a shaft 242. The shaft can be configured to be received by an aperture 282 formed in the lower body 202. The aperture 282 can likewise be configured to receive the shaft 242. The shaft 242 can extend in a longitudinal direction from the plunger portion 240, so that the shaft 242 is aligned with an axial direction 290 of the clutch 100.

While a hydraulic member 205 has been presented herein, the present disclosure also contemplates implementation with other types of biasing members instead of the hydraulic member 205. The biasing member could be configured to selectively disengage the lower body 202 from the upper body 201 as described above. For example, a spring based biasing member can be implemented in place of the hydraulic member 205. In other embodiments, an additional biasing member can be in included in addition to the hydraulic member 205.

In at least one embodiment, the clutch 100 can be configured to allow fluid to pass therethrough. When, the clutch is configured to allow fluid to pass therethrough, the shaft 242 of the plunger 240 can have an aperture 243 formed therethrough. Additionally, an aperture 282 can be formed in the lower body 202 and through the lower body 202 in an axial direction 290, thereby allowing fluid to flow through the clutch 100. For example, in some embodiments, a drilling fluid can be passed through the clutch 100. In other embodiments, a cleaning fluid can be passed through the clutch 100.

The clutch 100 can further include a thrust bearing 230 configured to take up thrust when the lower body 202 is disengaged from the upper body 201. In at least one embodiment, the thrust bearing 230 can be coupled to a plunger piston 240. The thrust bearing 230 can be configured to take up a thrust load of a drillstring above the clutch 100.

The additional figures presented herein provide further details regarding certain components of the clutch 100 as well as illustrate the clutch 100 in a compressed or disengaged configuration. While the compressed configuration is described herein as being a disengaged configuration and the tension configuration as being the engaged configuration, the present disclosure can be implemented in reverse.

Figure 3:
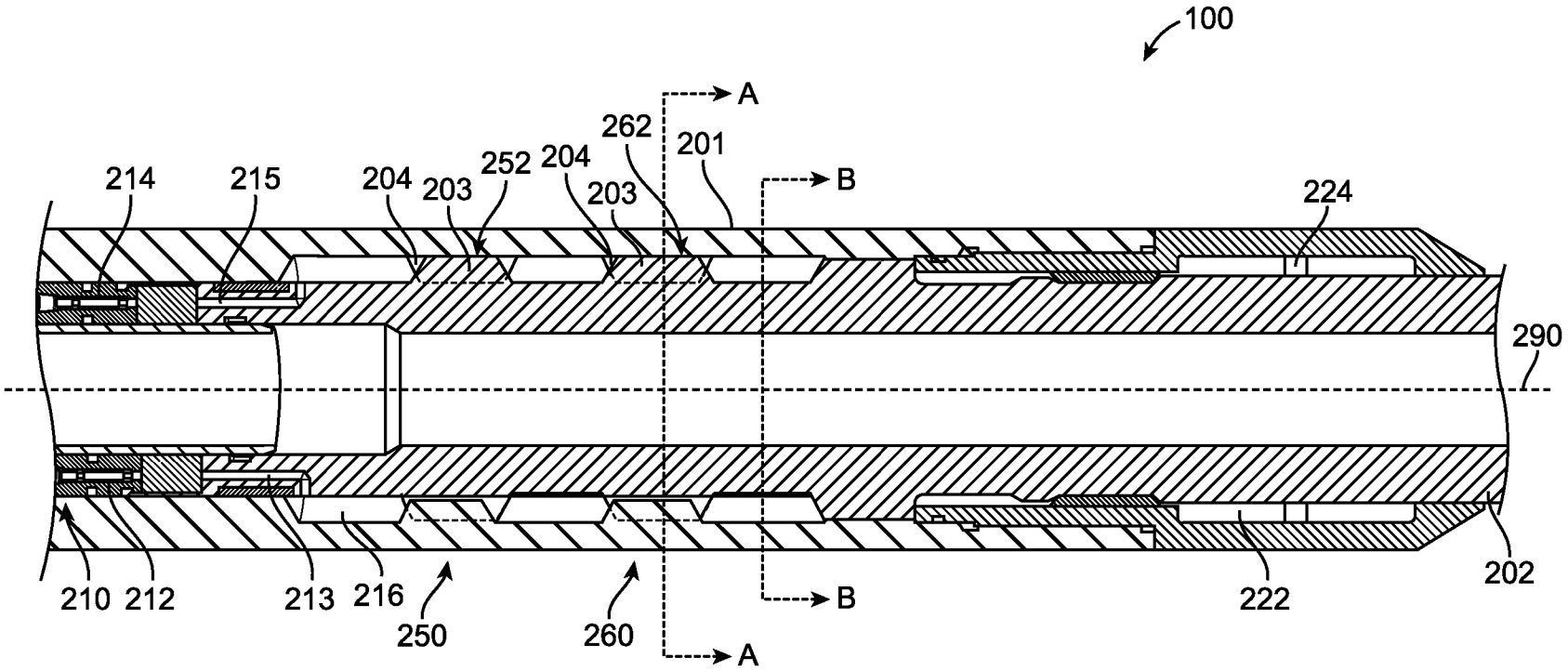
FIG. 3 is an partial cross-sectional view of a compression set downhole clutch when in tension in accordance with another exemplary embodiment.

FIG. 3 illustrates a partial cross-sectional view of a clutch 100 in tension, in accordance with an exemplary embodiment. The upper body 201 and lower body 202, as shown, are in a tension configuration or an engaged configuration. The at least one engagement surface 203 of the lower body 202 and the at least one engagement surface 204 of the upper body 201 are engaged. In at least one embodiment, the at least one engagement surface 203 of the lower body 202 and the at least one engagement surface 204 of the upper body 201 can be locked or substantially coupled whereby the upper body 201 and lower body 202 rotate together ensure there is no slipping from upper drillstring and lower drillstring.

A detailed cross-sectional view of the relief valve member 210 is also presented in FIG. 3. As illustrated, the relief valve member 210 can include a first relief valve 212 and a second relief valve 214. The first relief valve can be coupled to a second hydraulic chamber 222 by a first duct 213. The first duct 213 allows fluid to flow from the first relief valve 212 into the second hydraulic chamber 222. While a first duct 213 is illustrated, other examples including having the first relief valve in immediate communication the second hydraulic chamber 222. Additionally, other components can couple the first relief valve 212 to the second hydraulic chamber 222 in addition to the first duct 213. Also as illustrated, a second duct 215 can be provided to couple the second relief valve 214 to the second hydraulic chamber 222. The second duct 215 allows fluid to flow from the second hydraulic chamber 222 into the second relief valve 214. Additionally, in at least one embodiment, the relief valve 214 can be directly coupled to the second hydraulic chamber 222. In other embodiments, additional components can couple the second relief valve 214 to the second hydraulic chamber 222.

As further illustrated in FIG. 3, the second hydraulic chamber 222 can have a bottom formed by a moveable seal 224. The moveable seal 224 can have form a boundary between the second hydraulic chamber 222 and region of the compression set down clutch 100 that is open to surrounding environment. The second hydraulic chamber 222 can include an engagement surface portion 216 that is around the at least one engagement surface 204 of the upper body 201 and the at least one engagement surface 203 of the lower body 202. This portion 216 can provide for lubrication of the at least one engagement surface of the upper body 201 and the at least one engagement surface 203 of the lower body 202.

The at least one engagement surface 204 of the upper body 201 can include a first row 250 and a second row 260. The at least one engagement surface 203 of the lower body 202 can include a first row 252 and a second row 262.

Figure 4:
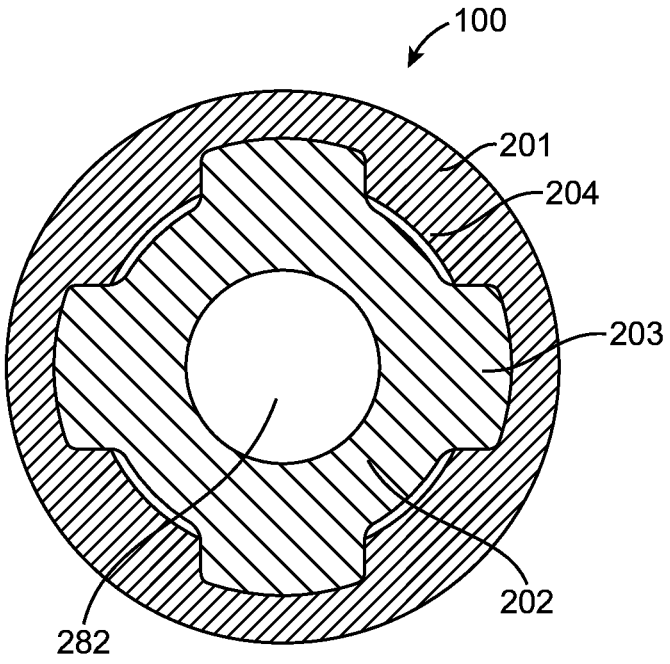
FIG. 4 is a cross-sectional view of A-A as shown in FIG. 3 in accordance with another exemplary embodiment.

Referring to FIG. 4, a cross-sectional view of A-A as indicated in FIG. 3 is illustrated in accordance with another exemplary embodiment. The cross-section A-A is of the at least one engagement surface 204 of the upper body 201 and the at least one engagement surface 203 of the lower body 202. As illustrated, the at least one engagement surface 204 of the upper body 201 comprises four engagement surfaces 204. The engagement surfaces 204 can be in the form of a spline. Likewise the at least one engagement surface 203 of the lower body 202 comprises four engagement surfaces 203, which can be in the form of a spline. As illustrated, the faces of the splines (203, 204) are configured to substantially matingly engage with one another to enable transfer of torque from the upper body 201 to the lower body 202, when the clutch 100 is in an engaged configuration.

Figure 5:
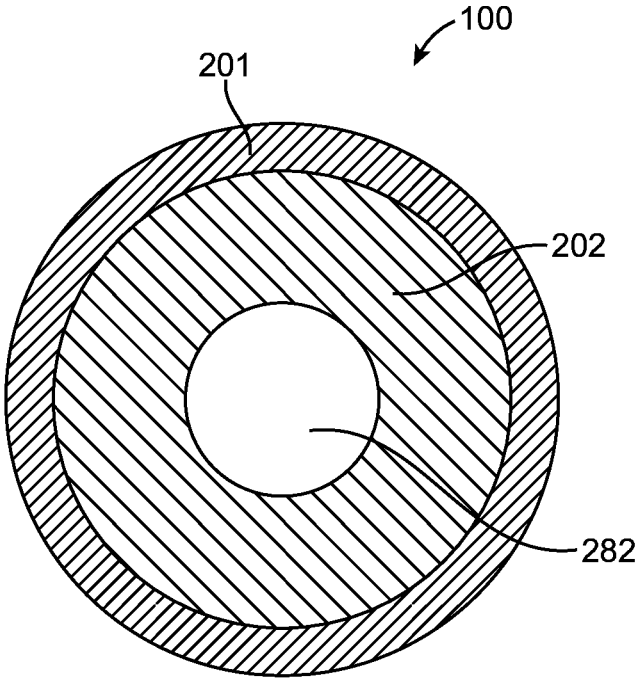
FIG. 5 is a cross-sectional view of B-B as shown in FIG. 3 in accordance with another exemplary embodiment.

Referring to FIG. 5, a cross-sectional view of B-B as shown in FIG. 3 is illustrated in accordance with another exemplary embodiment. The cross-section B-B is of the portion of the upper body 201 and lower body 202 that does not have at least one engagement surface (203, 204) in the engaged configuration. In at least one embodiment, the at least one engagement surface 204 of the upper body 201 can occupy the region between the upper body 201 and the lower body 202 in the disengaged configuration.

Figure 6:
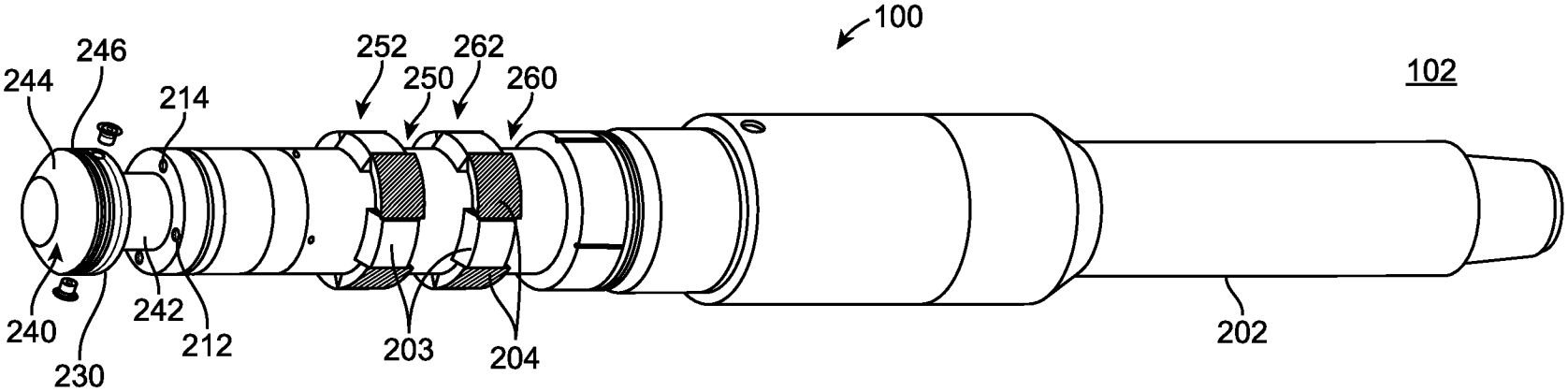
FIG. 6 is a perspective view of a lower body of a compression set downhole clutch when in tension in accordance with another exemplary embodiment.

Referring to FIG. 6, a partial perspective view of a lower body of a clutch 100 in an engaged configuration 102 is illustrated in accordance with another exemplary embodiment. The lower body 202 can have at least one engagement surface 203 located at an exterior thereof to engage with at least one engagement surface 204 of the upper body (not shown). As illustrated, a first row 250 of at least one engagement surfaces 204 of the upper body and a second row 260 of at least one engagement surface 204 of the upper body is illustrated. In the illustrated example, the first row 250 includes four engagement surfaces 204 of the upper body and the second row 260 includes four engagement surfaces 204 of the upper body. The clutch 100 can also include a first row 252 of at least one engagement surface 203 of the lower body 202 and a second row 262 of at least one engagement surface 203 of the lower body 202. While two rows are illustrated, the number of rows can vary depending on one or more of: the required torque to be transmitted, material properties, the diameter of the upper body 201, and the diameter of the lower body 202. As illustrated, the at least one engagement surface 203 of the lower body 202 and the at least one engagement surface 204 of the upper body 201 can be splines, as described above.

FIG. 6 also illustrates the plunger piston 240. The plunger piston 240 includes a shaft 242 that extends therefrom. The plunger piston 240 can include a head 244 that can have a face that is configured to couple or contact a corresponding face on the upper body 201. The plunger piston 240 can also include a seal 246 that seals the first hydraulic chamber at a top side. Additionally, a thrust bearing 230 can be coupled to the bottom side of the head 244 of the plunger piston 240. Additionally, as illustrated the clutch 100 can include a first relief valve 212 that has an opening into the first hydraulic chamber and a second relief valve 214 that has an opening into the first hydraulic chamber. In at least one embodiment, the clutch 100 can include a pair of first relieve valves 212 and a pair of second relief valves 214. In other embodiments, other numbers of relief valves (212, 214) can be present; the number of the first relief valves 212 does not need to match the number of second relief valves 214. When a pair of first relief valves 212 and a pair of second relief valves 214 are provided, this provision allows for higher flow area as well as provides redundancy, which can be beneficial if one of either pair of valves (212, 214) should fail.

Figure 7:
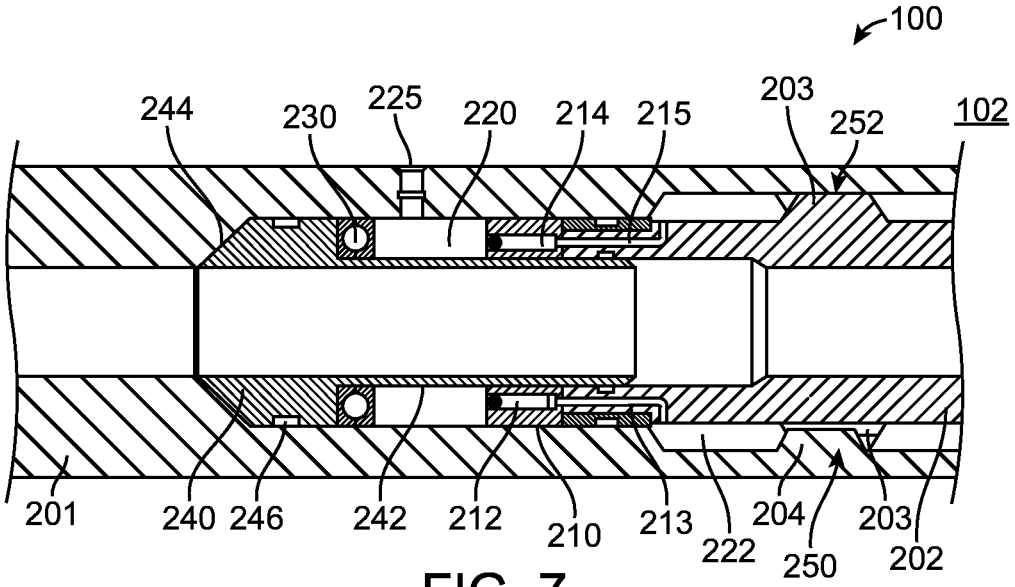
FIG. 7 is a partial cross-sectional view of a compression set downhole clutch hydraulic member when in tension in accordance with another exemplary embodiment.
Figure 8:
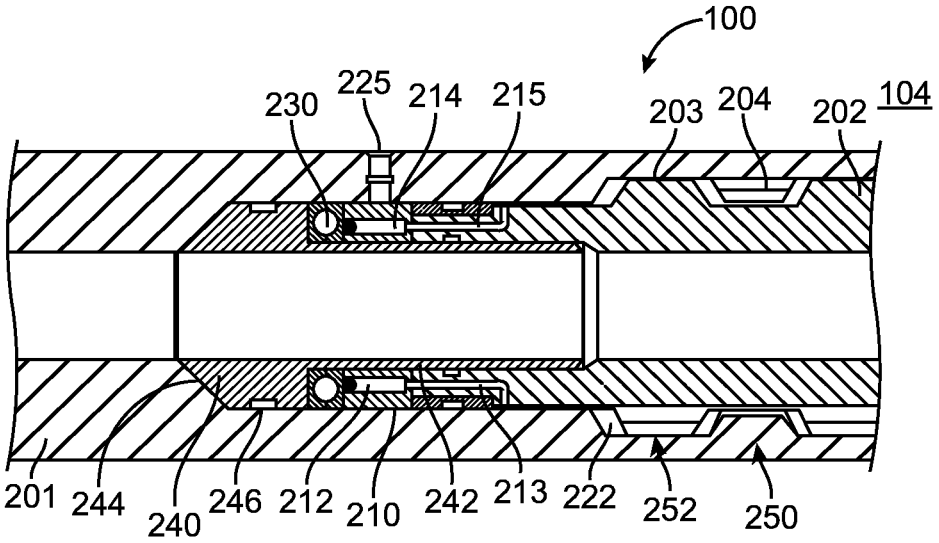
FIG. 8 is a partial cross-sectional view of a compression set downhole clutch hydraulic member when in compression in accordance with another exemplary embodiment.

Referring to FIGS. 7 and 8, a partial cross-sectional view of a clutch 100 is illustrated. In particular, the partial cross-sectional view focuses on the hydraulic member 210 in an engaged configuration 102 (FIG. 7) and a disengaged configuration 104 (FIG. 8). As illustrated in the engaged configuration 102, the piston plunger 240 is extended. The top face 244 of the piston plunger is configured to engage with the upper body 201. The piston plunger 240 can further include a seal 246 which forms an upper boundary of the first hydraulic chamber 220. The plunger piston 240 also includes a shaft 242 that extends therefrom. Also, a fluid fill port 225 can be provided to fill the first hydraulic chamber 220. Also, the first relief valve 212 can couple the first hydraulic chamber 220 to the second hydraulic chamber 222. As illustrated, a first duct 213 allows fluid to flow from the first relief valve 212 into the second hydraulic chamber 222. Additionally, a second relief valve 214 can be provided. A second duct 215 can be provided to couple the second relief valve 214 to the second hydraulic chamber 222.

Also, a thrust bearing 230 is located on the underside of the head 244 of the plunger piston 240. As illustrated in FIG. 7, the thrust bearing 230 is not active in that it does not take up any thrust. The at least one engagement surface 204 of the upper body 201 is shown as being engaged with the first engagement surface 203 of the lower body 202. As shown, the first engagement surface 204 of the upper body 201 is in a first row 250 and the first engagement surface 203 of the lower body 202 is in a first row 252.

Once the predetermined pressure on the clutch 100 is reached, the plunger piston collapses the first hydraulic chamber 220 as the first relief valve 212 opens thereby allowing fluid to flow from the first hydraulic chamber 220 into the second hydraulic chamber 222.

Once the first hydraulic chamber 220 has been substantially emptied, the clutch 100 transforms to the disengaged configuration as illustrated in FIG. 8. As illustrated in FIG. 8, the first engagement surface 204 of the upper body 201 is in a first row 250 and the first engagement surface 203 of the lower body 202 is in a first row 252. However, the first engagement surface 204 of the upper body 201 is free to rotate without contacting the first engagement surface 203 of the lower body 202. Additionally, the thrust bearing 230 contacts the relief valve member 210. The thrust bearing 230 is configured to take up the thrust of the upper body 201.

The clutch 100 can be returned to an engaged configuration 102, when the predetermined pressure is removed from the clutch 100 thereby allowing fluid to again fill the first hydraulic chamber 220 by passing through the second relief valve 214. In this way, the clutch 100 can be cycled a number of times.

Figure 9:
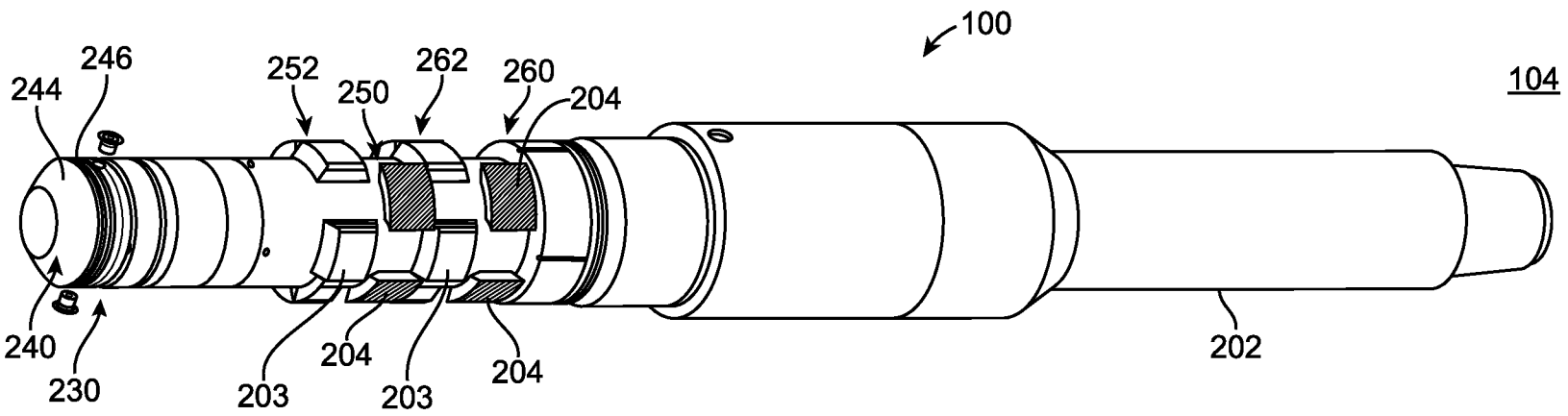
FIG. 9 is a perspective view of a lower body of a compression set downhole clutch when in compression in accordance with another exemplary embodiment.

Referring to FIG. 9, a partial perspective view of a lower body of a clutch 100 in a disengaged configuration 104 is illustrated. The lower body 202 can have at least one engagement surface 203 located at an exterior thereof to engage with at least one engagement surface 204 of the upper body (not shown). As illustrated, a first row 250 of at least one engagement surfaces 204 of the upper body and a second row 260 of at least one engagement surface 204 of the upper body is illustrated. In the illustrated example, the first row 250 includes four engagement surfaces 204 of the upper body and the second row 260 includes four engagement surfaces 204 of the upper body. The clutch 100 can also include a first row 252 of at least one engagement surface 203 of the lower body 202 and a second row 262 of at least one engagement surface 203 of the lower body 202. While two rows are illustrated, the number of rows can vary depending on one or more of: the required torque to be transmitted, material properties, the diameter of the upper body 201, and the diameter of the lower body 202. As illustrated, the at least one engagement surface 203 of the lower body 202 and the at least one engagement surface 204 of the upper body 201 can be splines, as described above.

In the disengaged configuration 104, the at least one engagement surface 204 of the upper body 201 is free to rotate without contacting the at least one engagement surface 203 of the lower body 202. In this way, the upper body 201 can continue to rotate without transferring torque or rotation motion to the lower body 202.

FIG. 9 also illustrates the plunger piston 240 in a collapsed configuration such that the shaft of the plunger piston 240 is not visible as compared with FIG. 6. Additionally, the thrust bearing that can be coupled to an underside of the head 244 of the plunger piston can contact the lower body 202 at relief valve member. Additionally, to seal the first hydraulic chamber at a top side a seal 246 can be provided.

Figure 10:
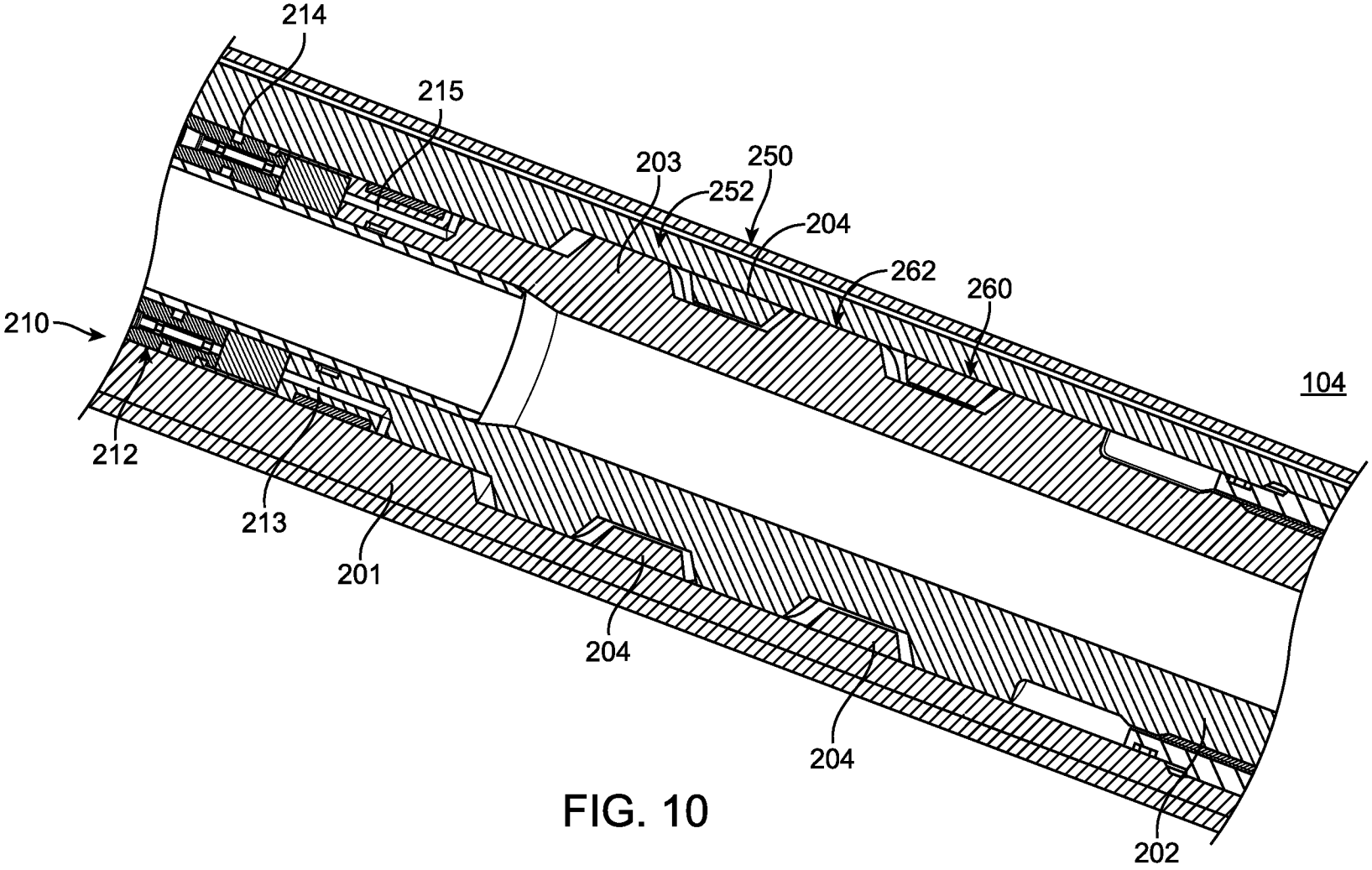
FIG. 10 is a partial cross-sectional view of a compression set downhole clutch when in compression in accordance with another exemplary embodiment.

Referring to FIG. 10, a cross-sectional view of a clutch 100 in a disengaged configuration 104 is illustrated. The lower body 202 can have at least one engagement surface 203 located at an exterior thereof to engage with at least one engagement surface 204 of the upper body (not shown). As illustrated, a first row 250 of at least one engagement surfaces 204 of the upper body and a second row 260 of at least one engagement surface 204 of the upper body is illustrated. In the illustrated example, the first row 250 includes four engagement surfaces 204 of the upper body and the second row 260 includes four engagement surfaces 204 of the upper body. The clutch 100 can also include a first row 252 of at least one engagement surface 203 of the lower body 202 and a second row 262 of at least one engagement surface 203 of the lower body 202. In the disengaged configuration 104, the at least one engagement surface 204 of the upper body 201 is free to rotate without contacting the at least one engagement surface 203 of the lower body 202. In this way, the upper body 201 can continue to rotate without transferring torque or rotation motion to the lower body 202.

More details regarding the relief valve member 210 are illustrated in FIG. 10, including the first relief valve 212 and the second relief valve 214. Additionally, the first duct 213 and the second duct 215 are further illustrated.

Figure 11:
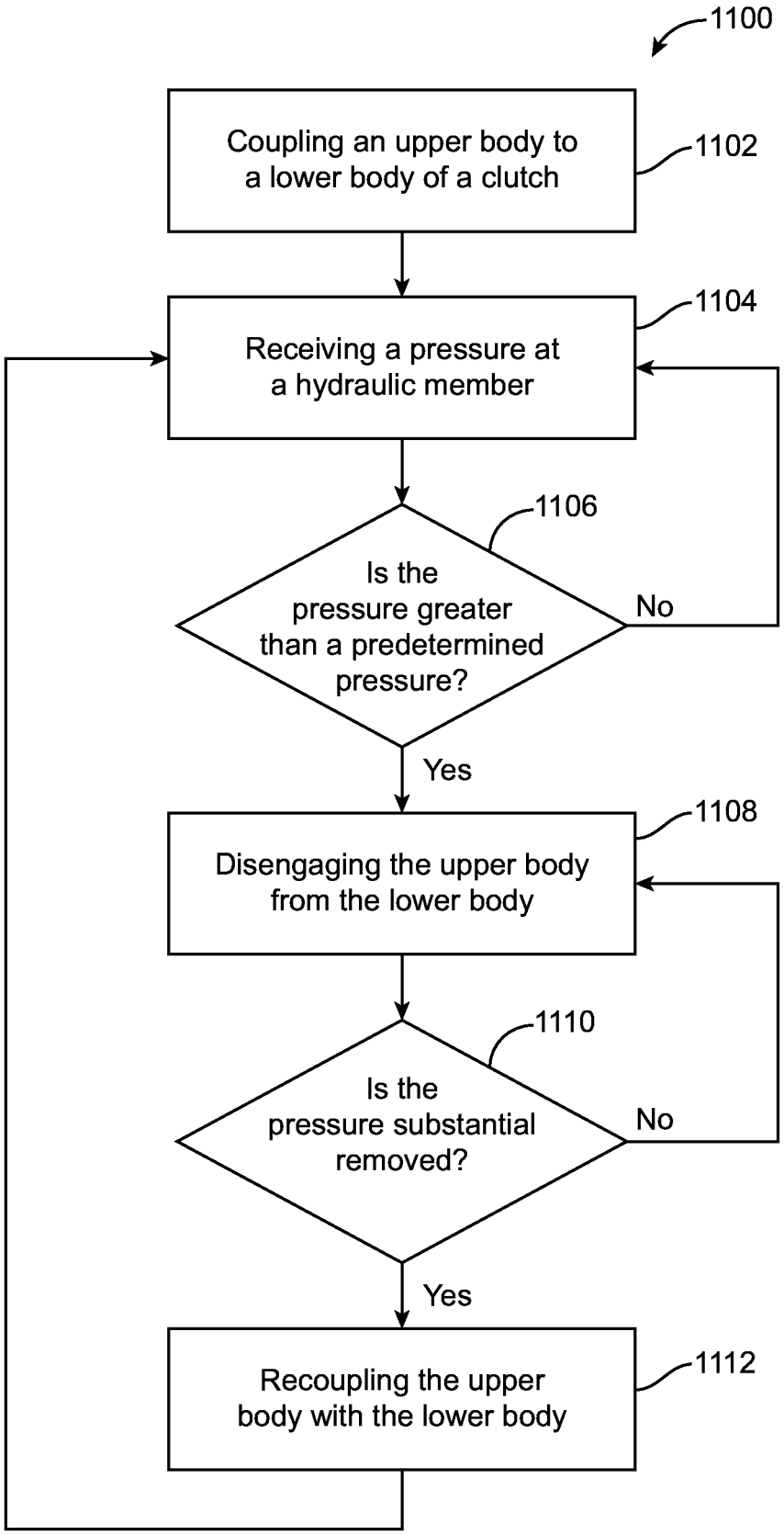
FIG. 11 is an example of a method according to an exemplary embodiment.

FIG. 11 illustrates an exemplary embodiment of a method 1100 according to the present disclosure. The method 1100 can be carried out using the clutch and tool as described above. Each block shown in FIG. 11 can represent one or more processes, methods or subroutines, carried out in the example method 1100.

The method 1100 can start with coupling an upper body to a lower body of a compression set downhole clutch (block 1102). In other embodiments, the method can start with the upper body disengaged from the lower body. The coupling of the upper body to a lower body can be through a coupling member. When the upper body is coupled to the lower body, the clutch can be described as being in an engaged configuration. The coupling of the lower body to the upper body can be as described above. For example, in the engaged configuration, at least one engagement surface of the upper body is configured to couple with a corresponding engagement surface of the lower body. In at least one example, the engagement surfaces are on interference members that form a splined connection between the upper and lower bodies that permits reciprocation, but prevents relative rotation of the bodies.

The method 1100 can further include receiving pressure at a hydraulic member (block 1104). The pressure received at the hydraulic member can be in response to a compressive force being applied upon the clutch-including tool. For example, the received pressure can be in response to the tool coming into contact with a collar or other restriction in the casing or borehole. Additionally, in at least one example, the received pressure can be in response to compressing the drillstring once the bit or other tool on a distal end contacts the bottom of the borehole.

The method 1100 can further include determining if the received pressure is greater than a predetermined pressure (block 1106). The determination that the pressure is greater than a predetermined pressure can be made using a first relief valve that has a first pressure setting. The first pressure setting can correspond to the predetermined pressure. Additionally, the determination that the pressure is greater than a predetermined pressure can be made by a hydraulic member. In at least one embodiment, the hydraulic member can include a first relief valve. The present method 1100 can be further adapted in view of the clutch and tool as described above.

The method 1100 can further include disengaging the upper body from the lower body when the received pressure is greater than the predetermined pressure (block 1108). As described above, disengagement of the upper body from the lower body can be responsive to the hydraulic member which permits motion of the upper body relative to the lower body. When the upper body moves relative to the lower body, the engagement surfaces of the upper body and lower body can move relative to one another thereby allowing the upper body to rotate independently of the lower body. The disengagement can further include additional sub-methods as described above in relation to the clutch and tool.

The method 1100 can further include determining if the pressure is substantially removed (block 1110). The determination can be made by the first relief valve. The first relief valve can be configured to close when the pressure is substantially removed. As described above, the pressure can be substantially removed when the gauge pressure on the hydraulic member is substantially zero. The above description provides other examples of the pressure being substantially removed, such as in the instance of low cracking pressure. For example, the cracking pressure can be less than 7000 pascals, or about one pound per square inch. In other examples, the low cracking pressure can be 2000 pascals, or about one third of a pound per square inch.

The method 1100 can further include recoupling the upper body with the lower body (block 1112). The recoupling of the upper body with the lower body can occur by the hydraulic member allowing relative translational motion of the upper body relative to the lower body. As the upper body and lower body return to the coupled configuration, the engagement surfaces of the lower body and upper body reengage and couple to one another causing the upper body and lower body to rotate in unison, but allowing their relative reciprocation.

The method 1100 can further include repeating disengagement of the upper body from the lower body as described above if the hydraulic member receives a predetermined pressure. In this regard, the present coupling/decoupling method 1100 for a compression set downhole clutch is repeatable.

As presented herein, the disclosure includes a compression set downhole clutch comprising an upper body (201) comprising at least one engagement surface (204); a lower body (202) comprising at least one engagement surface (203); the at least one engagement surface (204) of the upper body (201) and the at least one engagement surface (203) of the lower body (202) are each configured to couple with one another and rotate in unison in an engaged configuration (102); a hydraulic member (205) configured to be responsive to a predetermined pressure; and the hydraulic member (205) configured to disengage the at least one engagement surface (204) of the upper body (201) from the at least one engagement surface (203) of the lower body (202) in response to experiencing the predetermined pressure.

In at least one embodiment, the compression set downhole clutch wherein the hydraulic member (205) comprises a relief valve member (210) which is activated at the predetermined pressure.

In at least one embodiment, the compression set downhole clutch wherein the hydraulic member (205) comprises a first relief valve (212) and a second relief valve (214), the first relief valve (212) having a first pressure setting corresponding to the predetermined pressure and the second relief valve (214) having a second pressure setting that is less than the first pressure setting.

In at least one embodiment, the compression set downhole clutch wherein the second pressure setting corresponds to substantially zero gauge pressure.

In at least one embodiment, the compression set downhole clutch wherein the hydraulic member (205) further comprises a first hydraulic chamber (220) and a second hydraulic chamber (222) in fluid communication such that fluid is exchanged between the first hydraulic chamber (220) and the second hydraulic chamber (222) when the predetermined pressure is exceeded.

In at least one embodiment, the compression set downhole clutch further comprises a first hydraulic chamber (220) and a second hydraulic chamber (222), wherein the first relief valve (212) and the second relief valve (214) selectively fluidly couple the first hydraulic chamber (220) to the second hydraulic chamber (222).

In at least one embodiment, the compression set downhole clutch wherein the lower body (202) disengages from the upper body (201) in response to the first relief valve (212) opening at the predetermined pressure and allowing fluid to flow into the second hydraulic chamber (222) from the first hydraulic chamber (220).

In at least one embodiment, the compression set downhole clutch wherein the second relief valve (214) is set to allow fluid to flow from the second hydraulic chamber (222) into the first hydraulic chamber (220) in the event that the pressure is less than the first predetermined pressure.

In at least one embodiment, the compression set downhole clutch wherein the first hydraulic chamber (220) is located uphole relative to the first relief valve (212) and the second relief valve (214).

In at least one embodiment, the compression set downhole clutch wherein the second hydraulic chamber (222) has a movable seal (224) located downhole relative to the first relief valve (212) and the second relief valve (214), the movable seal (224) establishing a bottom of the second hydraulic chamber (222).

In at least one embodiment, the compression set downhole clutch further comprises a plunger piston (240) configured to collapse in response to experiencing a compression load, the collapse of the plunger piston (240) causing the at least one engagement surface (204) of the upper body (201) and the at least one engagement surface (203) of the lower body (202) to disengage from one another.

In at least one embodiment, the compression set downhole clutch further comprises a thrust bearing (230) coupled with the plunger piston (240), wherein the thrust bearing (230) is configured to take up a thrust load of a drillstring above the compression set downhole clutch (110).

In at least one embodiment, the compression set downhole clutch wherein each engagement surface (204) of the upper body (201) is located on a spline of the upper body and each engagement surface (203) of the lower body is located on a spline of the lower body.

In at least one embodiment, the compression set downhole clutch wherein splines of the upper body (201) comprise a first row (250) and a second row (260) of splines, and splines of the lower body (202) comprise a first row (252) and a second row (262) of splines.

In at least one embodiment, the compression set downhole clutch wherein each first row (250, 252) of splines comprises four interference members and each second row (260, 262) of splines comprises four interference members, and wherein each interference member comprises an engagement surface.

In at least one embodiment, the compression set downhole clutch further comprising a plunger portion (240) having a shaft (242) extending therefrom in a downhole direction, and an aperture (282) formed in the lower body (202) configured to receive the shaft (242).

In at least one embodiment, the compression set downhole clutch wherein the shaft (242) has an aperture (243) formed therethrough and the aperture (282) formed in the lower body (202) extends through the lower body (202) in an axial direction (290) thereby allowing fluid to flow through the compression set downhole clutch (100).

Additionally, the compression set downhole clutch can be implemented as part of a downhole tool. Still further, the compression set downhole clutch can be included in a drill string.

The present disclosure also includes one or more methods. In at least one embodiment, the present disclosure provides a method for operating a compression set downhole clutch, the method comprising coupling an upper body to a lower body of the compression set downhole clutch by a splined connection that permits reciprocation and prevents rotation between the upper and lower body in an engaged configuration; receiving pressure at a hydraulic member; and disengaging the upper body from the lower body when the received pressure is greater than a predetermined pressure.

In at least one embodiment, the method further comprises responsive to the received pressure, opening a first relief valve having a first pressure setting corresponding to the predetermined pressure, thereby causing fluid to flow through the valve and causing the lower body to disengage from the upper body.

In at least one embodiment, the method further comprises closing the first relief valve when gauge pressure at the hydraulic member is substantially zero; allowing fluid to flow through a second relief valve in a direction opposite of the flow of fluid through the first relief valve; and recoupling the upper body to the lower body into the engaged configuration and thereby causing the upper body to rotate in unison with the lower body.

The method can also include other processes, steps or procedures in order to carry out the above operation of the apparatus. The method can be implemented as part of operation of a tool, a drill string, or a drilling operation.

The embodiments shown and described above are only examples. Many details are often found in the art such as the other features of a clutch system. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A compression set downhole clutch comprising:

an upper body comprising at least one engagement surface;

a lower body comprising at least one engagement surface;

the at least one engagement surface of the upper body and the at least one engagement surface of the lower body are each configured to couple with one another and rotate in unison in an engaged configuration;

a hydraulic member configured to be responsive to a predetermined pressure; and the hydraulic member configured to disengage the at least one engagement surface of the upper body from the at least one engagement surface of the lower body in response to maintaining an actuation pressure equal to or greater than the predetermined pressure, the at least one engagement surface of the upper body engages the at least one engagement surface of the lower body upon relief of the actuation pressure, wherein the at least one engagement surface of the upper body remains disengaged from the at least one engagement surface of the lower body when the actuation pressure is equal to or greater than the predetermined pressure; and a plunger portion having a shaft extending therefrom in a downhole direction, and an aperture formed in the lower body configured to receive the shaft.

2. The compression set downhole clutch as recited in claim 1, wherein the hydraulic member comprises a relief valve member which is activated at the predetermined pressure.

3. The compression set downhole clutch as recited in claim 1, further wherein the plunger portion further comprises a plunger piston configured to collapse in response to experiencing a compression load, the collapse of the plunger piston causing the at least one engagement surface of the upper body and the at least one engagement surface of the lower body to disengage from one another.

4. The compression set downhole clutch as recited in claim 3, further comprising a thrust bearing coupled with the plunger piston, wherein the thrust bearing is configured to take up a thrust load of a drillstring above the compression set downhole clutch.

5. The compression set downhole clutch as recited in claim 1, wherein each engagement surface of the upper body is located on a spline of the upper body and each engagement surface of the lower body is located on a spline of the lower body.

6. The compression set downhole clutch as recited in claim 5, wherein splines of the upper body comprise a first row and a second row of splines, and splines of the lower body comprise a first row and a second row of splines.

7. The compression set downhole clutch as recited in claim 6, wherein each first row of splines comprises four interference members and each second row of splines comprises four interference members, and wherein each interference member comprises an engagement surface.

8. The compression set downhole clutch as recited in claim 1, wherein the shaft has an aperture formed therethrough and the aperture formed in the lower body extends through the lower body in an axial direction thereby allowing fluid to flow through the compression set downhole clutch.

9. A compression set downhole clutch comprising:

an upper body comprising at least one engagement surface;

a lower body comprising at least one engagement surface;

the at least one engagement surface of the upper body and the at least one engagement surface of the lower body are each configured to couple with one another and rotate in unison in an engaged configuration;

a hydraulic member configured to be responsive to a predetermined pressure; and the hydraulic member configured to disengage the at least one engagement surface of the upper body from the at least one engagement surface of the lower body in response to experiencing the predetermined pressure;

wherein the hydraulic member comprises a first relief valve and a second relief valve, the first relief valve having a first pressure setting corresponding to the predetermined pressure and the second relief valve having a second pressure setting that is less than the first pressure setting.

10. The compression set downhole clutch as recited in claim 9, wherein the second pressure setting corresponds to substantially zero gauge pressure.

11. The compression set downhole clutch as recited in claim 9, wherein the hydraulic member further comprises a first hydraulic chamber and a second hydraulic chamber in fluid communication such that fluid is exchanged between the first hydraulic chamber and the second hydraulic chamber when the predetermined pressure is exceeded.

12. The compression set downhole clutch as recited in claim 11, wherein the first hydraulic chamber is located uphole relative to the first relief valve and the second relief valve.

13. The compression set downhole clutch as recited in claim 12, wherein the second hydraulic chamber has a movable seal located downhole relative to the first relief valve and the second relief valve, the movable seal establishing a bottom of the second hydraulic chamber.

14. The compression set downhole clutch as recited in claim 9, further comprising a first hydraulic chamber and a second hydraulic chamber, wherein the first relief valve and the second relief valve selectively fluidly couple the first hydraulic chamber to the second hydraulic chamber.

15. The compression set downhole clutch as recited in claim 14, wherein the lower body disengages from the upper body in response to the first relief valve opening at the predetermined pressure and allowing fluid to flow into the second hydraulic chamber from the first hydraulic chamber.

16. The compression set downhole clutch as recited in claim 15, wherein the second relief valve is set to allow fluid to flow from the second hydraulic chamber into the first hydraulic chamber in the event that the pressure is less than the first predetermined pressure.

17. A method for operating a compression set downhole clutch, the method comprising:

coupling an upper body to a lower body of the compression set downhole clutch by a splined connection that permits reciprocation and prevents rotation between the upper and lower body in an engaged configuration;

receiving an actuation pressure at a hydraulic member; and disengaging the upper body from the lower body when the actuation pressure is equal to or greater than a predetermined pressure;

reengaging the upper body to the lower body upon when the actuation pressure is less than the predetermined pressure;

responsive to the actuation pressure, opening a first relief valve having a first pressure setting corresponding to the predetermined pressure, thereby causing fluid to flow through the valve and causing the lower body to disengage from the upper body;

closing the first relief valve when gauge pressure at the hydraulic member is substantially zero;

allowing fluid to flow through a second relief valve in a direction opposite of the flow of fluid through the first relief valve; and recoupling the upper body to the lower body into the engaged configuration and thereby causing the upper body to rotate in unison with the lower body.

18. The method as recited in claim 17, further comprising:

maintaining the actuation pressure at or greater than the predetermined pressure, thereby maintaining disengagement of the upper body from the lower body.

* * * * *